US006981866B2

(12) United States Patent
Katefidis

(10) Patent No.: US 6,981,866 B2
(45) Date of Patent: Jan. 3, 2006

(54) BURNER FOR A THERMAL POST-COMBUSTION DEVICE

(75) Inventor: Apostolos Katefidis, Gärtringen (DE)

(73) Assignee: Eisenmann Maschinenbau KG (Komplementar: Eisenmann-Stiftung), (DE)

( * ) Notice: Subject to any disclaimer, the term of this patent is extended or adjusted under 35 U.S.C. 154(b) by 0 days.

(21) Appl. No.: 10/642,401

(22) Filed: Aug. 15, 2003

(65) Prior Publication Data

US 2004/0219469 A1 Nov. 4, 2004

(30) Foreign Application Priority Data

Aug. 16, 2002 (DE) ..... 102 37 604

(51) Int. Cl.
*F23M 9/00* (2006.01)

(52) U.S. Cl. ..... 431/183; 431/182; 431/8

(58) Field of Classification Search ..... 431/183, 431/182, 8, 12
See application file for complete search history.

(56) References Cited

U.S. PATENT DOCUMENTS 5,486,108 A * 1/1996 Kubota ..... 431/181
5,494,437 A 2/1996 Kubota et al.
5,863,192 A * 1/1999 Motegi ..... 431/8

FOREIGN PATENT DOCUMENTS

| | | |
|---|---|---|
| CH | 499 748 | 11/1970 |
| DE | 44 06 369 A1 | 8/1995 |
| EP | 0 738 854 A2 | 10/1996 |

* cited by examiner

*Primary Examiner*—Alfred Basichas
(74) *Attorney, Agent, or Firm*—Factor & Lake

(57) ABSTRACT

A burner for a thermal post-combustion device comprises a combustion nozzle, which comprises a substantially hollow-cylindrical base member (1) at least virtually closed at one end by a cover (2). Fuel gas is supplied thereto axially at a particular pressure. The fuel gas flows out radially via main discharge openings (8) of the combustion nozzle. These main discharge openings (8) are at such a radial distance from the axis of the base member (1) and exhibit such a cross-section that, at the particular pressure of the supplied fuel gas, individual flames form at the main discharge openings (8) which substantially do not overlap. While maintaining the same total burner power, in this way the individual flames remain colder than in known burners, which produce a cohesive ball of flame instead of individual flames.

7 Claims, 3 Drawing Sheets

BURNER FOR A THERMAL POST-COMBUSTION DEVICE

The invention relates to a burner for a thermal post-combustion device having a combustion nozzle, which comprises a substantially hollow-cylindrical base member at least virtually closed at one end by a cover and to which fuel gas is supplied axially at a particular pressure, which gas flows out radially via a plurality of main discharge openings.

Thermal post-combustion devices are intended to burn as completely as possible and with maximum efficiency, i.e. with minimum burner power, the pollutants entrained in exhaust air requiring disposal. From the point of view of complete combustion, it would be favourable for the flame produced by the burner to exhibit a relatively high temperature; however, as the temperature increases, so does the formation of undesirable nitrogen oxides.

In the case of known burners of the above-mentioned type, as are currently available on the market, the base member of the combustion nozzle exhibits a relatively small diameter; the main discharge openings for the fuel gas are located directly in the jacket of the base member. In operation, a cohesive ball of flame forms around the end region of the combustion nozzle, which ball of flame exhibits an undesirably high temperature at least on the inside at a particular burner power. The consequence is the formation of undesirable nitrogen oxides.

The object of the present invention is to develop a burner of the above-mentioned type in such a way that the formation of nitrogen oxides is reduced without loss of burner power.

This object is achieved according to the invention in that the main discharge openings are arranged at such a radial distance from the axis of the base member and exhibit such a cross-section that, at the particular pressure of the supplied fuel gas, individual flames form at the main discharge openings which substantially do not overlap.

In the case of the burner according to the invention, therefore, the ball of flame which forms with the burners according to the prior art is broken up into a plurality of individual flames, each of which burns at a considerably lower temperature than the known ball of flame. Thus, markedly fewer nitrogen oxides form during combustion of the pollutants contained in the exhaust air, which is highly desirable for reasons of environmental protection.

In principle, the objective of producing a plurality of individual flames instead of a cohesive ball of flame may be achieved in that the end region of the base member, in which the main discharge openings are provided, is given a correspondingly large radius and the areas of the main discharge openings are so matched to the gas pressure that undesirable overlap of the individual flames is prevented. However, this design is not optimal with regard to supply of the exhaust air to be disposed of to the flames.

An embodiment of the invention is therefore preferred in which the main discharge openings are located at the ends of discharge tubes which project outwards from the base member in the form of a star. The exhaust air may in this way flow through the spaces between the discharge tubes to the individual flames. Moreover, the spaces may be used for visual monitoring of the flame.

It is also expedient for at least one small-area passage opening to be provided in the cover and/or in the region of the base member close to the cover, wherein the total area of all the small-area passage openings in the cover and/or the base member is less than the total area of all the main discharge openings. This measure makes it possible for an approximately axially directed central flame to be produced in addition to the individual flames supplying the actual burner power, which are of substantially radial orientation. This central flame is principally used to monitor the flame, in combination with a flame detector, for example a UV diode or an ionisation detector.

It is also advantageous for a small-area passage opening for a fuel gas forming a pilot flame to be provided in at least one discharge tube. The fuel gas exiting from this small-area passage opening is supplied to a suitable ignition device when the burner is brought into service.

The effect according to the invention of producing a plurality of individual flames instead of a single ball of fire by displacing the main discharge openings for the fuel gas radially outwards may be further reinforced in that a swirl means is provided which imparts eddy flow to the pollutant-containing exhaust air flowing around the combustion nozzle. The centrifugal force generated by this eddy flow urges the individual flames still further outwards; in this way, the distance between the individual flames increases and the average temperature drops further.

The result is a still lower content of nitrogen oxides in the treated exhaust air.

The swirl means appropriately comprises at least one set of blades extending radially outwards in the manner of spokes.

A still better effect is achieved if the swirl means comprises a first set of blades, which extend between a combustion nozzle housing coaxially surrounding the combustion nozzle and an intermediate ring, and a second set of blades, which extend between the intermediate ring and an outer ring.

At least some of the blades may have an inherently twisted shape.

An exemplary embodiment of the invention is explained in more detail below with reference to the drawings, in which.

Figure 1:
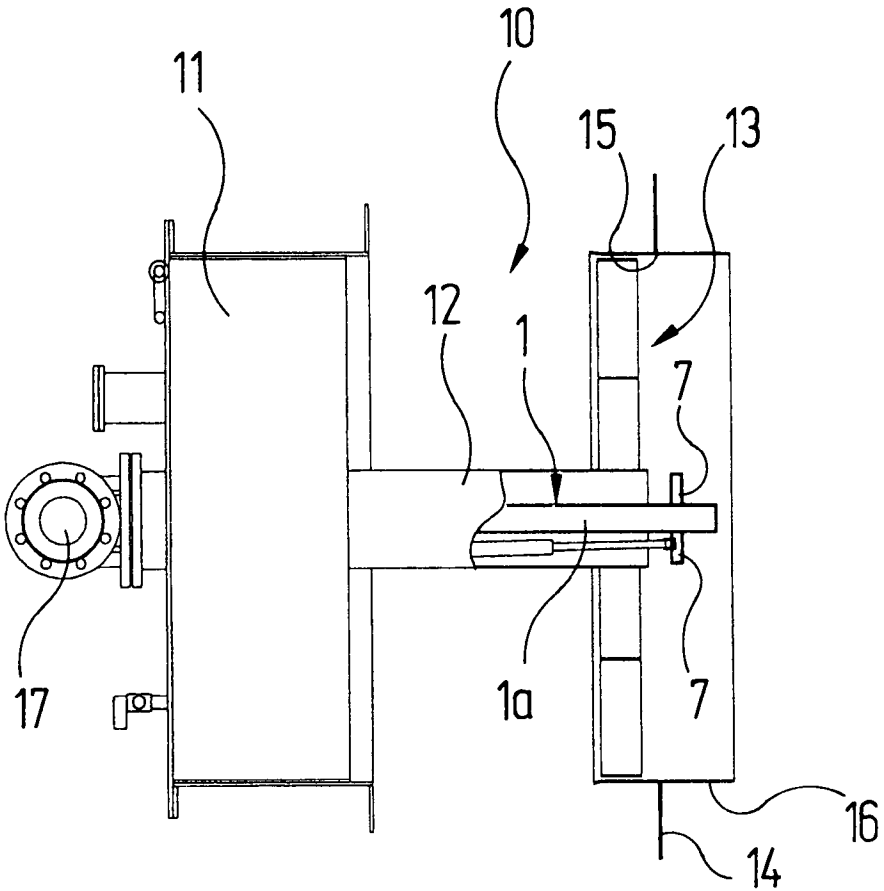
FIG. 1 is a schematic representation of a burner for a thermal post-combustion device.

The burner 10 illustrated in FIG. 1 is so designed that it may be introduced through an opening in the insulated outer housing of a thermal post-combustion device. To this end, it has a fitting piece 11, which may itself contain an insulating layer and, in the mounted state, closes the opening in the outer housing of the thermal post-combustion device. A cylindrical burner housing 12 projects into the inside of the thermal post-combustion device and carries at its inner end a swirl means, which as a whole bears the reference numeral 13. Details of this swirl means 13 will be explained below.

FIG. 1 shows the combustion chamber wall 14 of the thermal post-combustion device in the region of an opening 15, in which a cylindrical flame tube 16 is attached coaxially to the burner housing 12.

Figure 4:
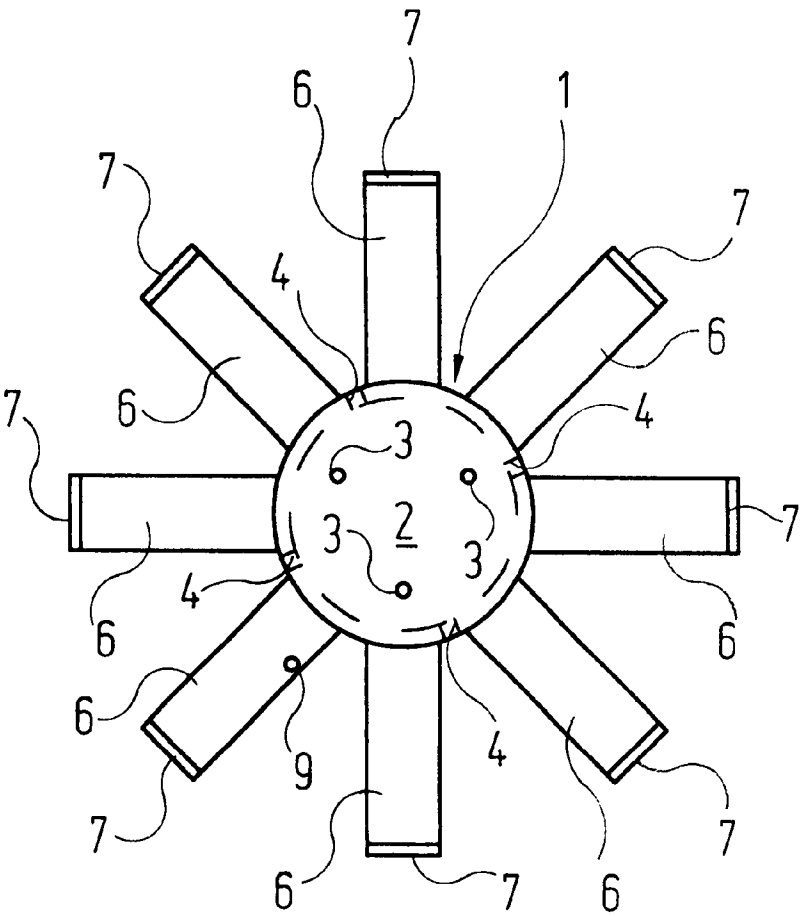
FIG. 4 is a plan view of the end region of the combustion nozzle of FIG. 1.
Figure 3:
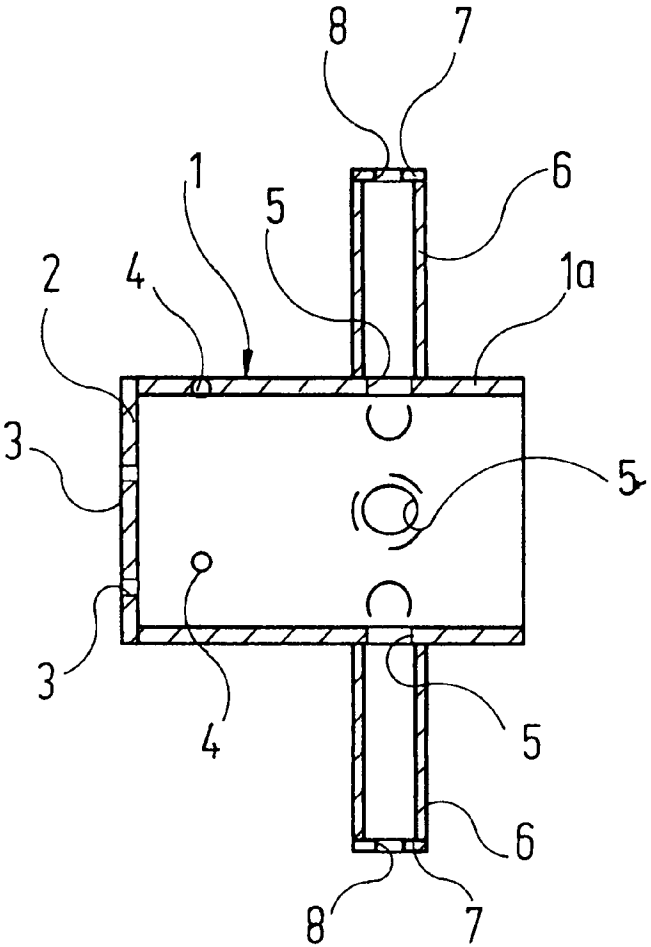
FIG. 3 is an axial section through a combustion nozzle for a thermal post-combustion device.

The burner housing 12 has a combustion nozzle 1 passing coaxially through it, the right-hand end region of which nozzle 1 is shown on an enlarged scale in FIGS. 3 and 4. This end region projects through the opening 15 in the combustion chamber wall 14 into the combustion chamber. The combustion nozzle 1 is supplied with fuel gas by a connection opening 17 arranged externally of the fitting piece 11.

The combustion nozzle 1 comprises a hollow-cylindrical base member 1*a*, which is closed at its end facing the combustion chamber, not shown, by a cover 2. The cover 2 has three small passage openings 3 passing through it, spaced angularly from one another by 120°.

The outer circumferential surface of the base member 1*a* also has passage openings 4 passing through it, which are located in a plane at a relatively small distance from the cover 2. As FIG. 4 shows, the combustion nozzle 1 illustrated comprises four such passage openings 4, which are each spaced angularly from one another by 90°. The function of the passage openings 3, 4 will be explained below.

At a greater axial distance from the cover 2, a total of 8 passage openings 5 are formed in the jacket of the base member 1*a*, which openings 5 have a markedly larger diameter than the passage openings 3 and 4. The passage openings 5 are each spaced angularly from one another by 45°. Eight discharge tubes 6 are positioned on the outer surface of the base member 1, coaxially with the passage openings 5, and project radially outwards in the form of a star. The discharge tubes 6 are also each closed at their radially outside ends by a cover 7, in which cover there is located a relatively large-area main discharge opening 8.

The open end of the base member 1*a* of the combustion nozzle 1 (on the right-hand side in FIG. 3) is connected with a feed pipe for fuel gas, in which there is preferably located a flow rate-increasing venturi nozzle, as known per se.

Figure 2:
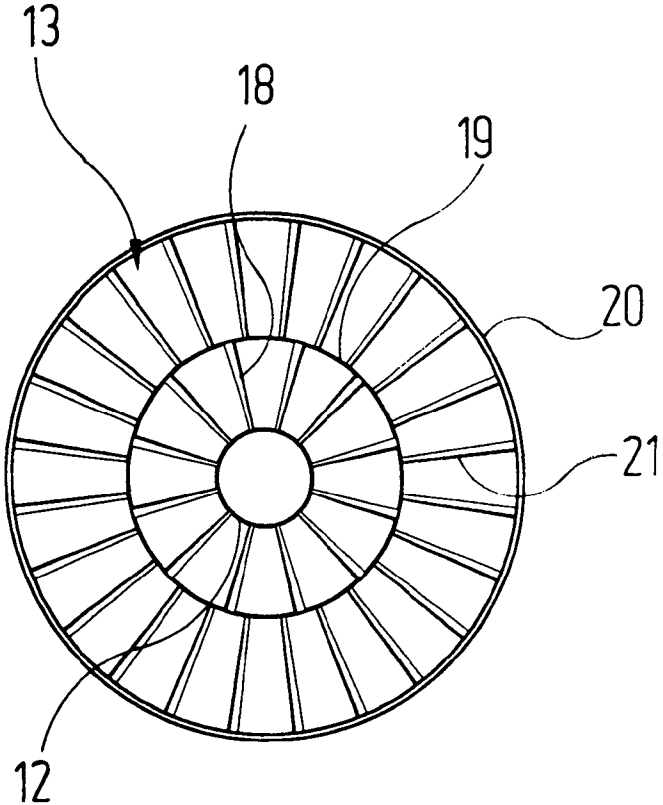
FIG. 2 is a plan view of a swirl means, which is used with the burner of FIG. 1.

The swirl means 13 attached to the internal end region of the burner housing 12 comprises, as is particularly clear from FIG. 2, a first set of radially extending blades 18 attached in the manner of spokes to the outer circumferential surface of the burner housing 12, which blades 18 are attached with their radially external ends to an intermediate ring 19. Between the intermediate ring 19 and an outer ring 20 concentric therewith, there extends a further set of radially extending blades 21, the ends of which are attached respectively to the intermediate ring 19 and the outer ring 20.

Figure 5:
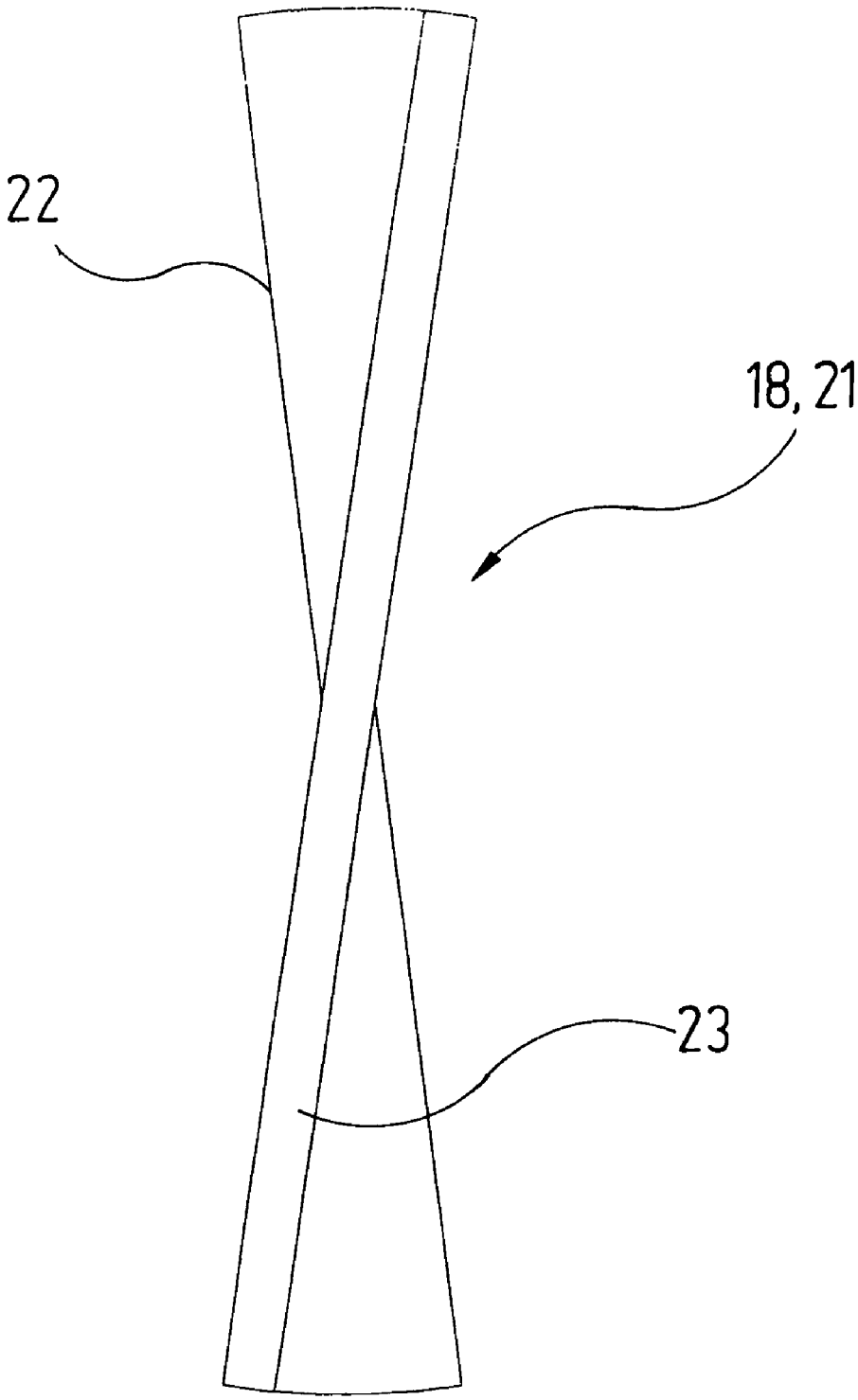
FIG. 5 is a side view of a blade of a swirl means contained in the burner of FIGS. 1 and 2.

The blades 18 are inherently twisted, as is particularly clear from FIG. 5. They are arranged between the burner housing 12 and the intermediate ring 19 or between the intermediate ring 19 and the outer ring 20 in such a way that one of their longitudinally extending edges (edge 22 in FIG. 5) forms an angle of approximately 30° with the axially parallel direction, while the other edge (edge 22 in FIG. 5) forms an angle of approximately 45° with the axially parallel direction.

The above-described burner operates as follows:

The fuel gas is supplied at a particular pressure from the right in FIG. 3 to the combustion nozzle 1. It then flows principally via the relatively large-area passage openings 5 in the jacket of the base member 1*a* and via the discharge tubes 6 to the main discharge openings 8. There it mixes with the pollutant-containing exhaust air to be treated, which is supplied in a suitable manner, to form a flame. The pressure of the incoming fuel gas, the radius at which the main discharge openings 8 are located and the size thereof are matched to one another in such a way that individual flames form at each of the various main discharge openings 8, i.e. said flames do not overlap. In this way, each of these individual flames remains relatively cool. The pollutant-containing exhaust air may be supplied in favourable manner through the wedge-shaped spaces between the discharge tubes 6.

The passage openings 3 in the cover 2 and the adjacent passage openings 4 in the jacket of the base member 1*a* produce a central flame, via which relatively little fuel gas is discharged however. This may be determined by an appropriate choice of the cross-sections of the passage openings 3, 4 in comparison with the cross-section of the main discharge openings 8. The central flame serves substantially only in flame monitoring; it is "observed" to this end by a flame sensor, for example a UV diode.

As FIG. 4 shows, one of the discharge tubes 6 is likewise provided with a small passage opening 9. The fuel gas discharged here is supplied to an ignition device at the start of operation; the flame thus arising serves as pilot flame for the radially directed individual flames exiting from the discharge tubes 6 and the central flame.

The swirl means 13 imparts eddy flow to the pollutant-containing exhaust air flowing around the base member 1*a* of the combustion nozzle 1. The centrifugal force produced by this eddy flow ensures that the flames, which form in the vicinity of the main discharge openings 8 of the discharge tubes 6, move radially outwards still further and in this way are at an even greater distance from one another. Altogether, with the same total power each individual flame of the combustion nozzle 1 burns at a considerably lower temperature than the cohesive ball of fire from the known combustion nozzles, in which the exhaust gases burned as they flowed out of the passage openings in the outer circumferential surface of the base member. The combustion gases therefore contain far fewer nitrogen oxides than in known thermal post-combustion devices.

What is claimed is:

1. A thermal post-combustion device comprising a burner, the burner having a combustion nozzle with a substantially hollow-cylindrical base member at least virtually closed at one end by a cover and to which fuel gas is supplied axially at a particular pressure, which gas flows out radially via a plurality of main discharge openings, wherein the main discharge openings are arranged at such a radial distance from the axis of the base member and exhibit such a cross-section that, at the particular pressure of the supplied fuel gas, individual flames form at the main discharge openings which substantially do not overlap;

wherein at least one small-area passage opening is provided in at least one of the cover and in the region of the base member close to the cover, wherein the total area of all the small-area passage openings in at least one of the cover and the base member is less than the total area of all the main discharge openings.

2. A thermal post-combustion device according to claim 1, wherein the main discharge openings are located at the ends of discharge tubes which project outwards from the base member in the form of a star.

3. A thermal post-combustion device comprising a burner, the burner having a combustion nozzle with a substantially hollow-cylindrical base member at least virtually closed at one end by a cover and to which fuel gas is supplied axially at a particular pressure, which gas flows out radially via a plurality of main discharge openings, wherein the main discharge openings are arranged at such a radial distance from the axis of the base member and exhibit such a cross-section that, at the particular pressure of the supplied fuel gas, individual flames form at the main discharge openings which substantially do not overlap;

wherein the main discharge openings are located at the ends of discharge tubes which project outwards from the base member in the form of a star; and, wherein a small-area passage opening for a fuel gas forming a pilot flame is provided in at least one discharge tube.

4. A thermal post-combustion device comprising a burner, the burner having a combustion nozzle with a substantially hollow-cylindrical base member at least virtually closed at one end by a cover and to which fuel gas is supplied axially at a particular pressure, which gas flows out radially via a plurality of main discharge openings, wherein the main discharge openings are arranged at such a radial distance from the axis of the base member and exhibit such a cross-section that, at the particular pressure of the supplied fuel gas, individual flames form at the main discharge openings which substantially do not overlap; and, wherein the burner comprises a swirl means, which imparts eddy flow to the pollutant-containing exhaust air flowing around the combustion nozzle.

5. A thermal post-combustion device according to claim 4, wherein the swirl means comprises at least one set of blades extending radially outwards in the manner of spokes.

6. A thermal post-combustion device according to claim 5, wherein the swirl means comprises a first set of blades, which extend between a combustion nozzle housing coaxially surrounding the combustion nozzle and an intermediate ring, and a second set of blades, which extend between the intermediate ring and an outer ring.

7. A thermal post-combustion device according to claim 5, wherein at least some of the blades have an inherently twisted shape.

* * * * *

UNITED STATES PATENT AND TRADEMARK OFFICE

CERTIFICATE OF CORRECTION

PATENT NO. : 6,981,866 B2
DATED : January 3, 2006
INVENTOR(S) : Katefidis

It is certified that error appears in the above-identified patent and that said Letters Patent is hereby corrected as shown below:

Title page,
Item [30], Foreign Application Priority Data, should read -- 102 37 604.2 --.

Signed and Sealed this

Fourteenth Day of March, 2006

JON W. DUDAS
*Director of the United States Patent and Trademark Office*